United States Patent [19]

Myerly

[11] 4,365,430

[45] Dec. 28, 1982

[54] SNOW REMOVAL ACCESSORY FOR SNOW THROWING DEVICES

[76] Inventor: James W. Myerly, Box 236, Ortonville, Minn. 56278

[21] Appl. No.: 278,490

[22] Filed: Jun. 29, 1981

[51] Int. Cl.[3] ..... E01H 5/00

[52] U.S. Cl. ..... 37/244

[58] Field of Search ..... 37/43 R, 43 A–43 K, 37/53, 10; 172/387, 393, 394

[56] References Cited

U.S. PATENT DOCUMENTS

| | | | |
|---|---|---|---|
| 3,490,057 | 1/1970 | Kahlbacher | 37/43 R |
| 3,779,319 | 12/1973 | Pease | 37/43 R |
| 4,295,285 | 10/1981 | Stevens | 37/43 D |

FOREIGN PATENT DOCUMENTS

| | | | |
|---|---|---|---|
| 2370824 | 7/1978 | France | 37/10 |

*Primary Examiner*—E. H. Eickholt

*Attorney, Agent, or Firm*—Williamson, Bains, Moore & Hansen

[57] ABSTRACT

The invention comprises a snow removal accessory usable with a power-driven snow thrower and includes a circular convex disc which will slide freely over snow accumulation and mounting means on the disc which suspend the snow thrower device a predetermined distance below the level of the disc so as to control the depth of cut available to the snow-thrower device and prevent its sinking to an unworkable level in deep snow. The invention permits lightweight, low-volume snow-throwing devices to be used in deep snow by cutting successively deeper into the snow on successive cuts.

7 Claims, 5 Drawing Figures

SNOW REMOVAL ACCESSORY FOR SNOW THROWING DEVICES

BACKGROUND OF THE INVENTION

The invention relates to the field of snow removal equipment and comprises an apparatus on which a powered snow-throwing device may be suspended a predetermined depth into an accumulation of snow to facilitate removal of snow which would otherwise be too deep for effective operation of the device.

In recent years the use of power-driven snow throwers and powered snow shovels has become increasingly popular as a means for fast, efficient, and convenient snow removal both on commercial and residential properties. While small to moderate sized self-propelled snow-throwing devices are generally effective for the clearing of driveways, small parking areas and long sidewalk runs, the fairly heavy self-propelled devices do not function effectively in small areas where high maneuverability is required or for the clearing of flights of steps or multi-level landscapes.

To solve the high maneuverability and low weight demands of clearing steps, multi-level terrain, and small residential use areas, a number of lightweight, easily maneuvered, power driven snow shovels have been developed. Typically such power shovels are compact, small, and easily carried by the operator. They frequently are not self-propelled and must be pushed along and into the snow to allow the shovel to pick up and discharge the snow in a generally forward direction. Such lightweight power shovels meet the requirements of low volume snow removal very satisfactorily where a relatively small area of surface must be cleared and the snow accumulation is not excessive.

When snow depths much over six inches are encountered, these lightweight power shovels must be held and manipulated by the user so as to skim off the snow in a series of deepening cuts until the ground level is reached, and accordingly up to now have been more limited in their ability to handle deep snow accumulations. Under deep snow conditions the continuous supporting of the power shovel's weight as well as the forward pushing of the shovel makes the snow removal task more physically demanding of the operator. The operating of the power shovel can be still more demanding where heavy moist snow is present, removal of such snow requiring a more shallow cut than does dry, finely powdered snow.

The present invention provides an accessory which in combination with a power shovel permits the convenient removal of a greater depth of accumulated snow and is constructed to adapt the power shovel to both heavy, wet snow and finely powdered snow.

SUMMARY OF THE INVENTION

The invention comprises a snow removal accessory usable with a snow-throwing device by which a support frame with mounting means for a snow thrower carries the snow thrower and suspends it downwardly a predetermined depth into the snow, the specific depth being suited to the depth and viscosity of the snow to be removed.

The support frame includes skid means suitable for supporting the weight of the snow thrower on the surface of the snow accumulation and preferably utilizes a circular convex disc having a central port therein through which the snow-thrower device is suspended downwardly into the snow. A pair of cradle members is mounted on the disc with a member positioned in each side of the port and provided with a vertical slot. The snow-thrower device is provided with laterally, outwardly extending trunnions on each end which are slidably received within the slots to retain the snow thrower on the support frame and suspend it downwardly through the port into the snow. The snow-thrower device may be quickly and easily mounted on and removed from the support frame by simply sliding the trunnions into and out of the slots on the cradle members. No fasteners of any kind are required to attach the snow thrower to the support frame.

The trunnions are coaxially aligned along a common axis and fit loosely in the slots, permitting upward and downward sliding movement of the trunnions along the slots so as to permit the snow-thrower device to move upwardly and downwardly in response to varying snow depths and to permit an operator to pivot the snow-thrower device about the trunnion axis to cause the snow thrower to bite into the snow.

Spacer blocks may be selectively inserted in the slots to control the vertical position of the trunnions in the slots and thereby limit the depth of the snow-thrower device's cut so the cut does not exceed a predetermined desired depth suited to the type of snow and the capacity of the snow thrower.

These and other objects and advantages of this invention will appear more fully from the following description made in conjunction with the accompanying drawings wherein like reference characters refer to the same or similar parts throughout the several views.

DESCRIPTION OF THE PREFERRED EMBODIMENTS

Figures 1, 5:
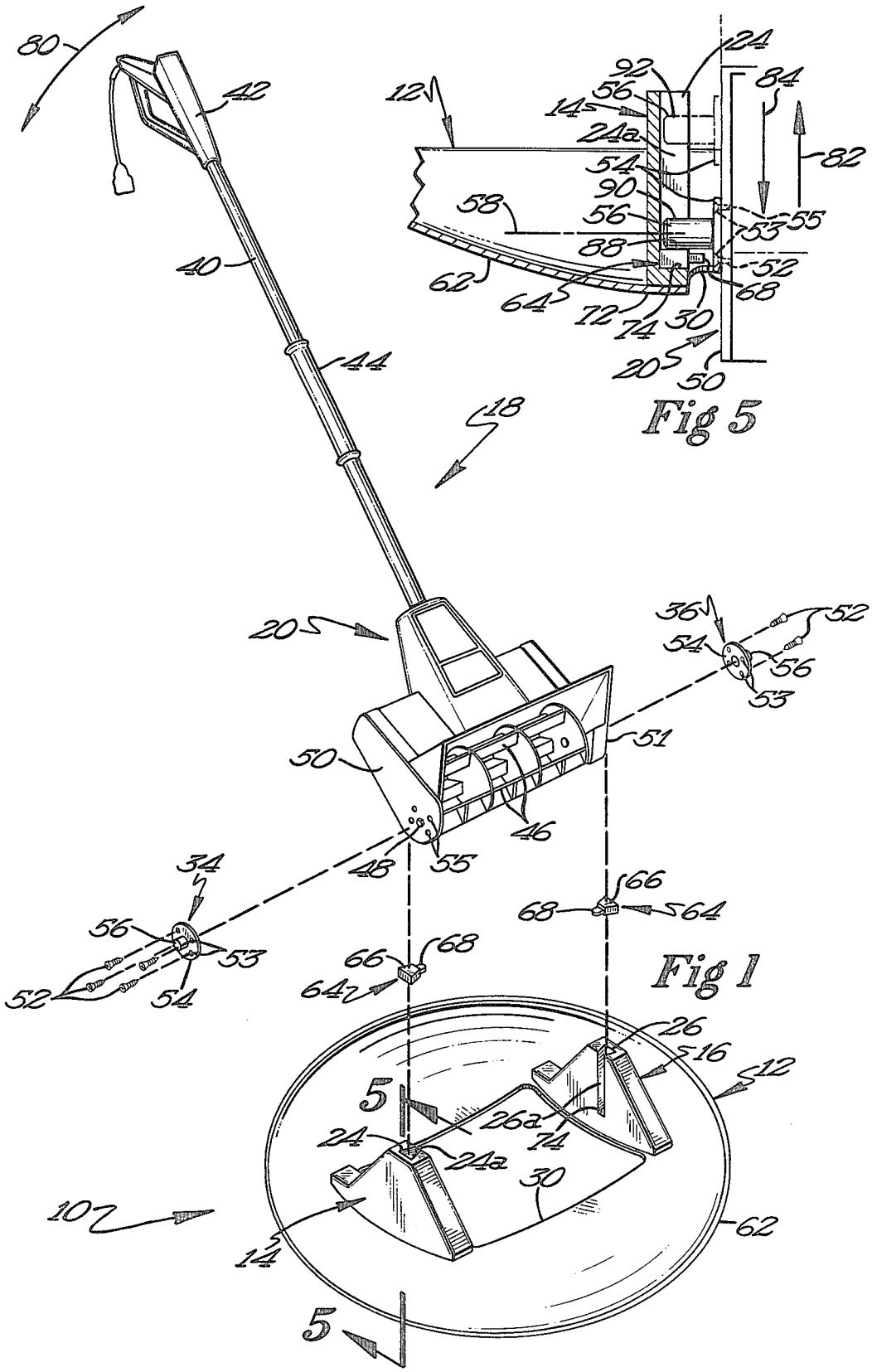
FIG. 1 is an exploded front perspective view of the snow-removal accessory used in cooperation with a snow-thrower device.
FIG. 5 is a cross-sectional front view of a cradle member taken along cutting plant 5—5 of FIG. 1 and showing alternative positions of the trunnions during operation.

Referring now to FIG. 1, the snow-removal accessory 10 has a support frame 12 and spaced apart upright cradle members 14 and 16, each such member having generally upright slots 24 and 26, respectively. These slots 24 and 26 slidably receive trunnions 34 and 36, respectively, which are rigidly fixed to the lateral sides of the head 20 of a snow-throwing device 18, permitting the head 20 to be suspended downwardly through a port 30 in the frame 12.

The snow-throwing device 18, while shown here as being a lightweight, electrical power snow shovel, may be comprised of any of a variety of commercially available snow-throwing devices. The snow-throwing device 18 is typically provided with a longitudinal shaft or handle 40 having handle grips 42 and 44 located therealong for the convenience of an operator. Such devices are presently available with either electrical or internal combustion engines and in a variety of different configurations and sizes; and all such snow-thrower devices as may be usable or adaptable to the present invention are within the purview of the invention and may be utilized with the snow-removal accessory described herein.

Figure 3:
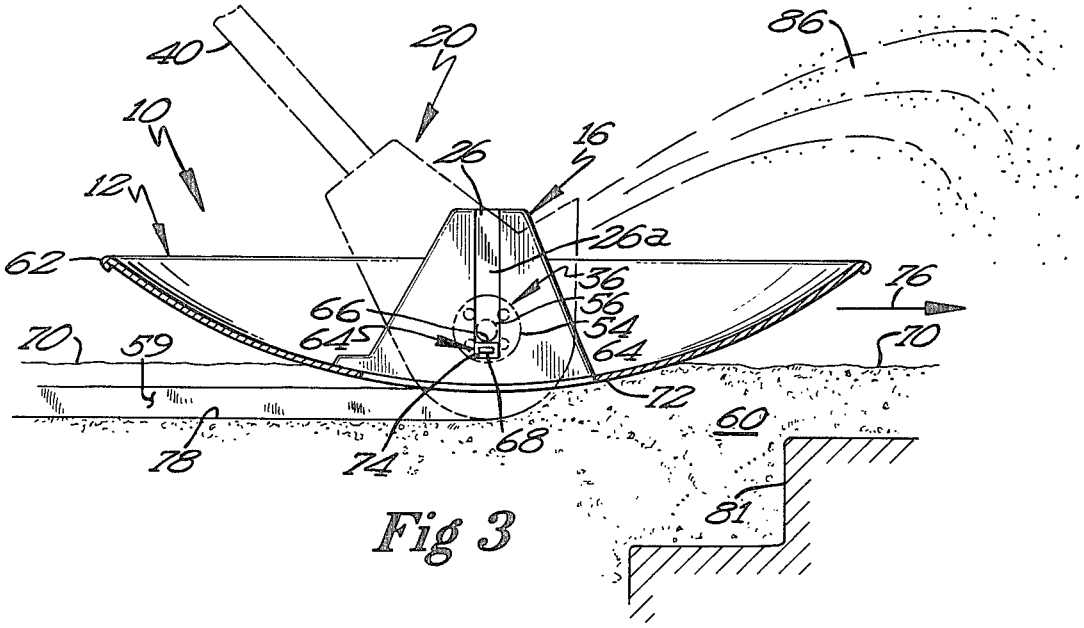
FIG. 3 is a side elevation view of the snow-removal accessory of FIG. 1 taken along cutting plane 3—3 of FIG. 2 in section and partially in phantom and showing a snow-thrower device mounted on the accessory and in operation on a snow accumulation.

Typically such snow-thrower devices as would be best used with the invention are not self-propelled and utilize a power head 20 in which is located a series of rapidly rotating snow-removal vanes or paddles 46 which revolve about a central axis 58 defined by the center line of bolts 48 and engage the snow and urge it forwardly and upwardly of the head as shown by blown snow 86 in FIG. 3. Because the detailed operation and structure of such snow-thrower device is well known to the art, no further description will be offered herein as to their detailed structure and operation.

Referring now to FIGS. 1, 3, and 5, trunnions 34 and 36 are mounted to the opposed lateral sides 50 and 51 of the power shovel head 20 by any known means such as screws 52 which pass freely through countersunk bores 53 in the trunnion mounting flange 54 and are threadably received in bores 55 in the sides 50 and 51 of the head.

Each of the trunnions 34 and 36 has an outwardly, laterally extending post 56, the axis 58 of each of the posts 56 being coaxially aligned with one another and oriented generally horizontally when the snow-thrower device 18 is operated with the accessory 10. Trunnions 34 and 36 are mounted at a vertical location on side plates 50 and 51 which will permit trunnion posts or shafts 56 to support vanes 46 at an elevation where they can make a four to six inch cut.

Referring again to FIGS. 1–3, the support frame 12 preferably utilizes a generally circular convex disc as a skid means to support the accessory 10 and the snow-thrower device 18 on the upper surface 70 of a snow accumulation 60. The disc 62, which may be formed of any appropriate material including plastic or metal, has a generally rectangular port 30 formed therein of a size suitable for receiving the head 20 of the device 18 so that the head may be lowered downwardly through the port into and confronting the snow accumulation 60, as best shown in FIG. 3. While a specific, generally rectangular port 30 is shown, other configurations may be utilized and adopted which are suitable to the specific cross-sectional area of the head of a given snow-thrower device and are within the purview of the invention. Although a specific circular, disc-shaped skid means has been shown, it should be understood that other skid means may be utilized with the invention including various types of skis and runners suitable for the needed support, and all such alternative skid structures are within the purview of the invention.

Upright cradle members 14 and 16 may be formed of any suitable material such as plastic, wood, metal, or a combination of such materials, and such members are rigidly mounted to the upper surface of the disc 62 by screws, rivets, or any other suitable means known to the art. The cradle members 14 and 16 along with the trunnions 34 and 36 collectively define a mounting means by which a snow-thrower device 18 may be retained on and suspended from the frame 12.

Figure 2:
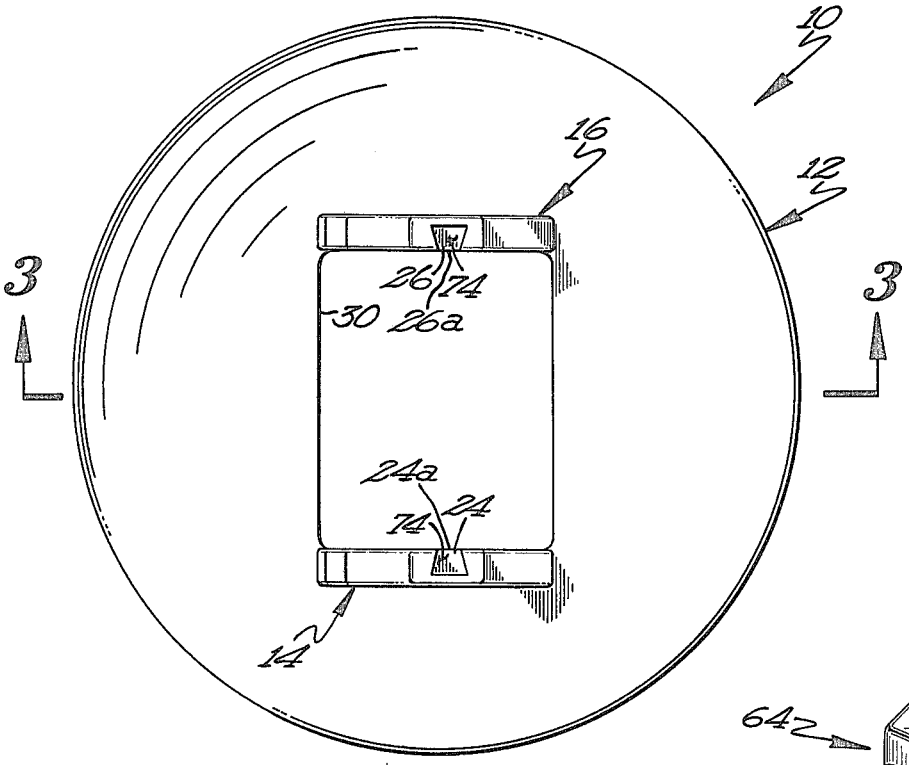
FIG. 2 is a top plan view of the support frame of the snow-removal accessory.

The cradle members 14 and 16 are provided with upright slots 24 and 26, respectively, each of which has a tapered cross-section with the narrowed end of the taper defining the slot openings **24*a* and 26*a* as best shown in FIG. 2. Both trunnions have their laterally extending posts 56 slidably retained in the slots 24 and 26 so as to allow free upward and downward movement in directions 82 and 84, respectively, to permit the head 20 to be adjusted vertically to determine the depth of the cut 59 into the snow 60**.

Figure 4:
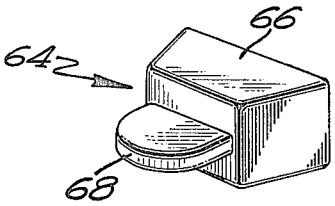
FIG. 4 is a perspective view of a spacer block usable with the accessory.

A pair of substantially identical spacer blocks 64 have a trapezoidal cross-sectional configuration 66 (FIG. 4) substantially identical to the tapered cross-section of the slots 24 and 26 but sized slightly smaller for free sliding movement upwardly and downwardly within the slots, the shown tapered configuration serving to retain the blocks 64 in the slots but permitting easy removal by upward sliding withdrawal from the slots. By inserting one or more spacer blocks 64 within the vertical slots, the maximum degree of downward travel of the posts 56 of trunnions 34 and 36 is closely controlled. Thus, the positioning of the head 20 of the snow-throwing device may be at any predetermined depth below the lower surface 72 of the disc 62 (FIG. 3). Each spacer block 64 may be of any suitable vertical thickness and is preferably provided with an outwardly extending tongue 68 which may be grasped by an operator for ease of removal of the block 64 from the slot 24 or 26. While only two spacer blocks 64 are shown as being used with the cradle members, it should be understood that a plurality of such spacer blocks may be used, depending upon the depth to which the head 20 is to be suspended below disc 62 and are within the purview of the invention.

In operation, when it is desired to remove a substantial depth of accumulated snow 60 (FIG. 3), the operator first positions the disc 62 of accessory 10 on the surface 70 of the snow (FIG. 3) and then determines the depth to which he wishes the head 20 of the snow-throwing device 18 to extend below the lower surface 72 of the disc. When the snow is of such a nature that the snow-removal device 18 can easily cope with its viscosity even with the posts 56 at the bottom 74 of the slots 24 and 26, the head 20 is lowered through the port 30 to depth 78 with the laterally extending trunnion posts 56 resting on the bottom 74 of the slots. During downward insertion of the posts 56 into the slots, the viscosity of the snow below the disc 62 may hinder downward movement of the head 20 into the snow and, if so, the operator need not force the head downwardly, but merely actuates the power to the snow-thrower device 18 and lets the head 20 mechanically remove sufficient snow 60 to permit it to slip downwardly to position 74 in the slots as the accessory 10 is manually urged forwardly in direction 76 by the operator.

With the head 20 firmly supported in the cradle members 14 and 16 and the posts 56 at the bottoms 74 of the slots, the operator manually urges the snow-thrower device 18 and the accessory 10 forwardly by pushing the shaft 40 in direction 76 and the device then removes the snow 60 as it is encountered along its path to the depth 78 as shown in FIG. 3.

When the snow has a viscosity too great for the device 18 to remove snow to a depth of cut as great as depth 78, the snow-thrower device 18 is lifted upwardly clear of the slots 24 and 26 and an equal number of spacer blocks 64 dropped into each slot to provide a new and higher level 88 on which the posts 56 of the trunnions will rest as shown in FIG. 5, thereby reducing the distance at which the head 20 is suspended below the disc and reducing the depth of the cut.

During operation as the accessory 10 and the snow-thrower device 18 move forwardly in the direction 76, the depth of snow accumulation can change suddenly as when the snow-thrower device encounters a concealed step 81. When the head 20 contacts the step 81, the operator simply lifts the head 20 by upward movement of the shaft 40, causing the posts 56 to slide or float freely upwardly along slots 24 and 26 from lower position 90 to raised position 92 (FIG. 5), permitting rapid depth adjustment to accommodate a range of different levels and potential obstacles.

The operator may pivot the snow-thrower device about axis 58 by upward or downward swinging of the shaft 40 in directions 80 to cause the device to more effectively bite into various snow conditions so as to improve and speed snow removal.

The port 30 is shown generally centered in support disc 12 in FIG. 2. Experience has shown that in actual practice it may be preferable to locate port 30 more towards the front edge of disc 12 in the direction of travel with more of the disc area that rests on the snow rearwardly of opening 30. This ensures that the rear end of the disc will not drop down as snow is removed, thereby keeping the disc 12 substantially level.

It is also to be noted that the weight of support disc 12 and the snow-throwing machine distributed over the disc area will have the effect of compressing snow. This results in increasing the depth of snow effectively removed per pass.

While the preferred embodiments of the present invention have been described, it should be understood that various changes, adaptations and modifications may be made therein without departing from the spirit of the invention and the scope of the appended claims.

What is claimed is:

1. A snow removal accessory usable with a power-driven snow-throwing device on the upper surface of an accumulation of snow comprising:

a support frame including skid means for placement on the upper surface of the accumulation and capable of sliding movement on the upper surface while supporting the weight of the snow-throwing device, said skid means comprising a substantially circular disc having a port therethrough for downward suspension of the snow-throwing device below said disc; and mounting means on said frame and connectable to the snow-throwing device for retaining the snow-throwing device on the frame and for suspending the snow-throwing device a predetermined distance below the level of said skid means so that the device extends within and confronts the snow accumulation so as to remove the accumulation to a predetermined depth.

2. The combination of claim 1 wherein said disc is convexly curved with the convex surface supportable on the snow accumulation to encourage free sliding movement of the convex surface over the snow accumulation with reduced resistance between said convex surface and the accumulation while said disc supports the snow-throwing device.

3. A snow removal accessory usable with a power-driven snow throwing device on the upper surface of an accumulation of snow comprising:

a support frame including skid means for placement on the upper surface of the accumulation and capable of sliding movement on the upper surface while supporting the weight of the snow-throwing device; and mounting means on said frame and connectable to the snow-throwing device on the frame and for suspending the snow-throwing device a predetermined distance below the level of said skid means so that the device extends within and confronts the snow accumulation so as to remove the accumulation to a predetermined depth, said mounting means including a pair of spaced apart, upwardly extending cradle members capable of receiving and retaining the snow-thrower device therebetween, and each of said cradle members including an upright slot and said mounting means further including a pair of trunnions attachable to and extending laterally from the snow-thrower device, one of said trunnions being slidable within each of said slots to permit free upward and downward floating movement of said trunnions within said slots.

4. The combination of claim 3 wherein said trunnions have axes which are coaxially aligned within said slots for swinging movement about said axes of said trunnions to permit an operator to pivot the snow-throwing device about said axes to facilitate better contact between the snow accumulation and the device.

5. The combination of claim 3 wherein said slots each have a lower terminal end and wherein said accessory further includes a pair of spacer blocks slidably mounted within said slots to support said trunnions a predetermined distance above the terminal ends of said slots so as to control the position of said snow-thrower device relative to said skid means.

6. Snow removal apparatus usable on the upper surface of an accumulation of snow comprising:

a support frame including skid means for placement on the upper surface of the accumulation and capable of sliding movement on the upper surface while supporting the weight of a snow-throwing device;

mounting means on said frame and connectable to the snow-throwing device for retaining the snow-throwing device on the frame and for suspending the snow-throwing device a predetermined distance below the surface of said skid means so that the device extends within and confronts the snow accumulation so as to remove the accumulation to a predetermined depth; and a power driven snow-throwing device swingably mounted to said support frame for movement about a horizontal axis so that an operator can pivot said snow-thrower device about said horizontal axis.

7. A snow removal accessory usable with a power-driven snow-throwing device on the upper surface of an accumulation of snow comprising:

a support frame including skid means for placement on the upper surface of the accumulation and capable of sliding movement on the upper surface while supporting the weight of the snow-throwing device; and mounting means on said frame and connectable to the snow-throwing device for retaining the snow-throwing device on the frame and for suspending the snow-throwing device a predetermined distance below the level of said skid means so that the device extends within and confronts the snow accumulation so as to remove the accumulation to a predetermined depth, said snow-thrower device being mounted for upward and downward sliding movement relative to said skid means to permit said snow-thrower device to float relative to said skid means so as to permit an operator to control the amount of the snow-thrower device confronting the snow accumulation and so that the snow-thrower device can move upwardly in response to diminishing depths of snow or unexpected obstructions located beneath the snow accumulation.

* * * * *